US010610874B2

(12) United States Patent
Wang et al.

(10) Patent No.: US 10,610,874 B2
(45) Date of Patent: Apr. 7, 2020

(54) HANDHELD SHOWER HEAD WITH ADJUSTABLE FLOW RATE

(71) Applicants: Xiamen Lota International Co., Ltd., Xiamen, Fujian (CN); Lota Xiamen Industry Co., Ltd., Xiamen, Fujian (CN)

(72) Inventors: Xuedong Wang, Xiamen (CN); Jiangcheng Zhang, Xiamen (CN); Xiaofei Guo, Xiamen (CN); Zheng Chen, Xiamen (CN)

(73) Assignees: XIAMEN LOTA INTERNATIONAL CO., LTD., Xiamen, Fujian (CN); LOTA XIAMEN INDUSTRY CO., LTD., Xiamen, Fujian (CN)

( * ) Notice: Subject to any disclaimer, the term of this patent is extended or adjusted under 35 U.S.C. 154(b) by 55 days.

(21) Appl. No.: 15/993,604

(22) Filed: May 31, 2018

(65) Prior Publication Data

US 2019/0224694 A1 Jul. 25, 2019

(30) Foreign Application Priority Data

Jan. 19, 2018 (CN) ..... 2018 1 0054260

(51) Int. Cl.

| | |
|---|---|
| ***B05B 1/18*** | (2006.01) |
| ***B05B 1/16*** | (2006.01) |
| ***B05B 1/30*** | (2006.01) |
| ***B05B 12/00*** | (2018.01) |
| ***E03C 1/04*** | (2006.01) |
| ***B05B 12/08*** | (2006.01) |

(52) U.S. Cl.

CPC ..... *B05B 1/18* (2013.01); *B05B 1/1618* (2013.01); *B05B 1/3013* (2013.01); *B05B 12/087* (2013.01); *B05B 12/002* (2013.01); *E03C 1/0405* (2013.01)

(58) Field of Classification Search

CPC ..... B05B 1/16; B05B 1/1609; B05B 1/1618; B05B 1/1627; B05B 1/18; B05B 1/185; B05B 1/30; B05B 1/3013; B05B 1/3026; B05B 12/002; E03C 1/0405

See application file for complete search history.

(56) References Cited

U.S. PATENT DOCUMENTS

| | | | | |
|---|---|---|---|---|
| 5,383,604 A * | 1/1995 | Boesch | ..... | B05B 1/1618 239/447 |
| 7,766,260 B2 * | 8/2010 | Lin | ..... | B05B 1/18 239/389 |
| 8,448,667 B2 * | 5/2013 | Meehan | ..... | E03C 1/0404 137/637.1 |

(Continued)

*Primary Examiner* — Darren W Gorman
(74) *Attorney, Agent, or Firm* — Leong C. Lei

(57) ABSTRACT

A handheld shower head includes a shower head body, a water inlet assembly and a water outlet assembly mounted on the shower head body. The water inlet assembly includes a water inlet body and a flow control device. The flow control device includes a gasket, a return spring, a control valve shaft, and a control button. The control valve shaft passes through the flow control chamber of the water inlet body. A lower portion of the control valve shaft is connected with the gasket. The control button is connected with an upper portion of the control valve shaft. The handheld shower head can control the flow rate of water discharge and is user-friendly.

11 Claims, 4 Drawing Sheets

(56) References Cited

U.S. PATENT DOCUMENTS

| | | | | |
|---|---|---|---|---|
| 2004/0227014 | A1* | 11/2004 | Williams | B05B 1/1618 239/443 |
| 2008/0067264 | A1* | 3/2008 | Erickson | B05B 1/1618 239/445 |
| 2008/0105764 | A1* | 5/2008 | Jianglin | B05B 1/1618 239/526 |
| 2012/0012676 | A1* | 1/2012 | Hu | B05B 1/1663 239/525 |
| 2016/0136659 | A1* | 5/2016 | Erickson | B05B 1/1618 239/443 |
| 2018/0280995 | A1* | 10/2018 | Huang | B05B 1/185 |

* cited by examiner

HANDHELD SHOWER HEAD WITH ADJUSTABLE FLOW RATE

BACKGROUND OF THE INVENTION

1. Field of the Invention

The present invention relates to a shower head, and more particularly, to a handheld shower head with adjustable flow rate.

2. Description of the Prior Art

In general, a conventional handheld shower head discharges water at a consistent flow rate. The shower head cannot adjust the flow rate or increase the impact force of the water flow. If the user wants to increase the flow rate, there is no way to achieve it. It is inconvenient for use.

SUMMARY OF THE INVENTION

The primary object of the present invention is to provide a handheld shower head with adjustable flow rate, which can control the flow rate of water discharge and is user-friendly.

In order to achieve the aforesaid object, the handheld shower head of the present invention comprises a shower head body, a water inlet assembly and a water outlet assembly mounted on the shower head body. The water inlet assembly includes a water inlet body and a flow control device. The water inlet body is fitted in the shower head body. The water inlet body has a water inlet channel, a first flow channel, a second flow channel, and a flow control chamber. A side of the flow control chamber is formed with a water inlet hole communicating with the water inlet channel Upper and lower portions of the flow control chamber are respectively formed with a first water outlet opening and a second water outlet opening opposite to each other. A first water inlet of the first flow channel communicates with the first water outlet opening. A second water inlet of the second flow channel communicates with the second water outlet opening. A first water outlet of the first flow channel and a second water outlet of the second flow channel communicate with a water inlet end of the water outlet assembly. The flow control device includes a gasket, a return spring, a control valve shaft, and a control button. The control valve shaft is movable up and down to pass through the flow control chamber. A lower portion of the control valve shaft is connected with the gasket. The gasket is located in the flow control chamber and is movable to close the first water outlet opening and the second water outlet opening. The return spring is disposed between the gasket and the second water outlet opening. Upper and lower ends of the return spring abut against the gasket and the water inlet body, respectively. The control button is connected with an upper portion of the control valve shaft and is movably fitted on the shower head body.

Preferably, the first water inlet of the first flow channel has a diameter greater than that of the second water inlet of the second flow channel.

Preferably, a check valve is provided in the second flow channel.

Preferably, a pressure relief channel is formed between the shower head body and the water inlet body. A bottom of the second water outlet opening is provided with a pressure relief hole communicating with the pressure relief channel. The bottom of the second water outlet opening is provided with a pad that is movable to close the pressure relief hole.

Preferably, the pad includes an elastic extension plate and a connecting post connected to a middle portion of the elastic extension plate. The elastic extension plate has a thickness that is gradually reduced from the middle portion of the elastic extension plate toward a periphery of the elastic extension plate. The elastic extension plate is movably attached to the bottom of the second water outlet opening. The connecting post is in clearance fit with the pressure relief hole.

Preferably, the water inlet assembly further includes a first sealing seat. The first water outlet opening extends upwardly to pass through a side wall of the water inlet body. The first sealing seat is fitted on the first water outlet opening. The first sealing seat is formed with a perforation through which the control valve shaft passes and a water passageway communicating with the first water outlet opening and the first flow channel. The shower head body is provided with a first mating hole for movement of the control button.

Preferably, an outer wall of the first sealing seat is formed with at least two first ledges. An outer wall of the water inlet body is formed with a first engaging block to engage with the first ledges.

Preferably, a side wall of the control valve shaft is formed with two annular grooves. The gasket is fitted on the control valve shaft and located between the two annular grooves. Two C-shaped retaining rings are fitted in the two annular grooves, respectively.

Preferably, the water outlet assembly includes a water diversion body, a functional water switching device, and a water outlet panel. The water diversion body is inserted into the shower head body. The water diversion body has a water inlet passage, a first water diversion passage, a second water diversion passage, and a functional water switching chamber. The water inlet body is connected with the water diversion body. A water inlet end of the water inlet passage communicates with the first water outlet of the first flow channel and the second water outlet of the second flow channel A side of the functional water switching chamber is formed with a water inlet communicating with the water outlet end of the water inlet passage. Upper and lower portions of the functional water switching chamber are respectively formed with a first water diversion opening and a second water diversion opening opposite to each other. The first water diversion opening and the second water diversion opening are in communication with the first diversion passage and the second water diversion passage, respectively. The functional water switching device includes a switching valve shaft, a sealing ring, and a switching button. The switching valve shaft is movable up and down to pass through the functional water switching chamber. A lower portion of the switching valve shaft is connected with the sealing ring that is located in the functional water switching chamber and is movable to close the first water diversion opening and the second water diversion opening. A middle portion of the switching button is hinged to the water diversion body. One end of the switching button is connected to an upper portion of the switching valve shaft. The water outlet panel is fitted on the shower head body and is formed with two functional water chambers communicating with the first water diversion passage and the second water diversion passage, respectively.

Preferably, the water outlet assembly further includes a second sealing seat. The first water diversion opening extends upwardly to pass through a side wall of the water diversion body. The second sealing seat is fitted on the first water diversion opening. The second sealing seat is formed with a through hole through which the switching valve shaft passes and a flow passage communicating with the first water diversion opening and the second water diversion opening. The shower head body is provided with a second mating hole for movement of the switching button.

Preferably, an outer wall of the second sealing seat is formed with at least two second ledges. An outer wall of the water diversion body is formed with a second engaging block to engage with the second ledges.

Preferably, the lower portion of the switching valve shaft is formed with an annular recess. The sealing ring is fitted in the annular recess.

Accordingly, the present invention is able to control the flow rate through the flow control device on the water inlet assembly. In a normal water inlet state, the water from the water inlet channel flows through the second flow channel into the water outlet assembly to spray water. When the control button is pressed, the water from the water inlet channel flows through the first flow channel into the water outlet assembly to spray water. In this way, the flow rate of the shower head can be switched. Moreover, the present invention utilizes the water flow and the return spring to control the position of the gasket, so that the flow control device can be returned when the water supply is cut off. The shower head is convenient for use.

DETAILED DESCRIPTION OF THE PREFERRED EMBODIMENTS

In order to further explain the technical solution of the present invention, embodiments of the present invention will now be described, by way of example only, with reference to the accompanying drawings.

First Embodiment

Figure 1:
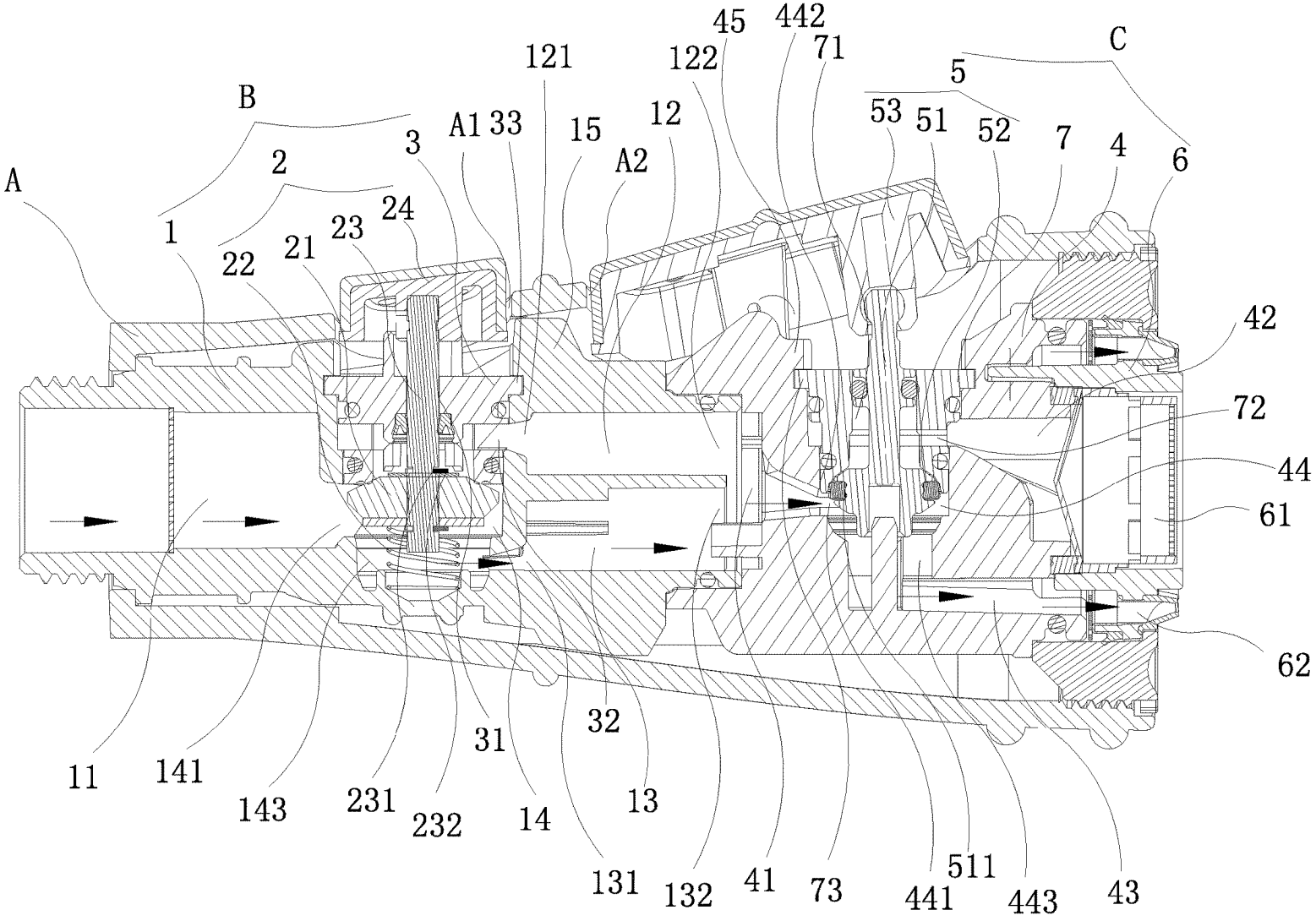
FIG. 1 is a first cross-sectional view in accordance with a first embodiment of the present invention (the water flows out from the second flow channel)
Figure 2:
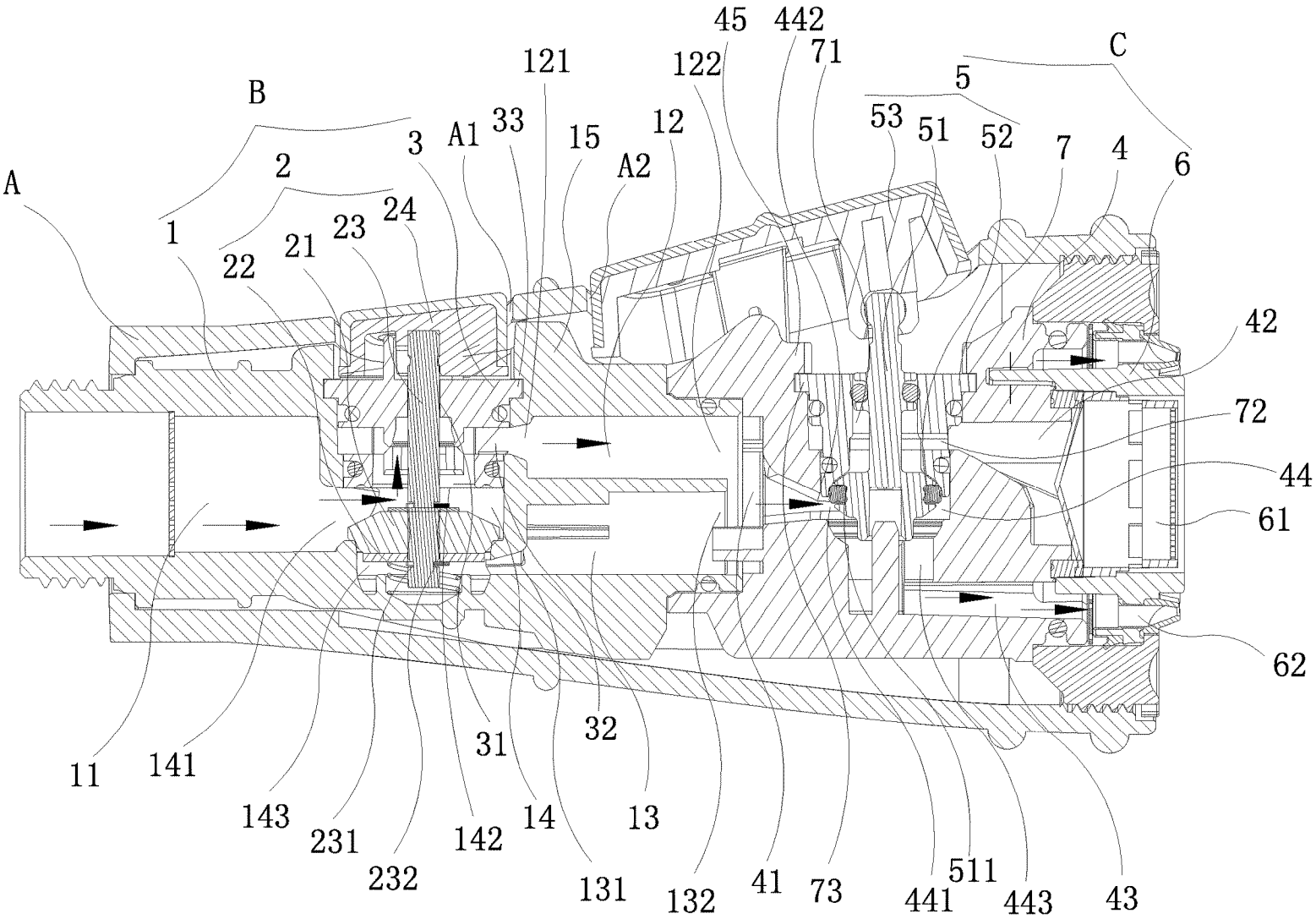
FIG. 2 is a second cross-sectional view in accordance with the first embodiment of the present invention (the water flows out from the first flow channel)

As shown in FIG. 1 and FIG. 2, a handheld shower head with adjustable flow rate of the present invention includes a shower head body A, a water inlet assembly B and a water outlet assembly C mounted on the shower head body A.

The water inlet assembly B includes a water inlet body 1 and a flow control device 2. Through the flow control device 2, the flow rate of the water inlet body 1 can be adjusted so as to provide different spray functions.

Specifically, the water inlet body 1 is fitted in the shower head body A. The water inlet body 1 has a water inlet channel 11, a first flow channel 12, a second flow channel 13, and a flow control chamber 14. A side of the flow control chamber 14 is formed with a water inlet hole 141 communicating with the water inlet channel 11. Upper and lower portions of the flow control chamber 14 are respectively formed with a first water outlet opening 142 and a second water outlet opening 143 opposite to each other. A first water inlet 121 of the first flow channel 12 communicates with the first water outlet opening 142. A second water inlet 131 of the second flow channel 13 communicates with the second water outlet opening 143. Both a first water outlet 122 of the first flow channel 12 and a second water outlet 132 of the second flow channel 13 communicate with a water inlet end of the water outlet assembly C. The diameter of the first water inlet 121 of the first flow channel 12 is greater than the diameter of the second water inlet 131 of the second flow channel 13, so that the flow rate of the first flow channel 12 is a large flow rate and the flow rate of the second flow channel 13 is a small flow rate.

The flow control device 2 includes a gasket 21, a return spring 22, a control valve shaft 23, and a control button 24. The control valve shaft 23 can slide up and down to pass through the flow control chamber 14. A lower portion of the control valve shaft 23 is connected with the gasket 21. The gasket 21 is located in the flow control chamber 14 and is movable to close the first water outlet opening 142 and the second water outlet opening 143 for controlling the first flow channel 12 and the second flow channel 13 to communicate with or not to communicate with the water inlet channel 11. The return spring 22 is disposed between the gasket 21 and the second water outlet opening 143. Upper and lower ends of the return spring 22 abut against the gasket 21 and the water inlet body 1, respectively. The control button 24 is connected with an upper portion of the control valve shaft 23 and is movably fitted on the shower head body A. In order to install the flow control device B, specifically, the water inlet assembly B further includes a first sealing seat 3. The first water outlet opening 142 extends upwardly to pass through the side wall of the water inlet body 1. The first sealing seat 3 is fitted on the first water outlet opening 142. The first sealing seat 3 is formed with a perforation 31 through which the control valve shaft 23 passes and a water passageway 32 communicating with the first water outlet opening 142 and the first flow channel 12. The shower head body A is provided with a first mating hole A1 for movement of the control button 24. Wherein, the outer wall of the first sealing seat 3 is formed with at least two first ledges 33. The outer wall of the water inlet body 1 is formed with a first engaging block 15 to engage with the first ledges 33 so as to fix the first sealing seat 3. The side wall of the control valve shaft 23 is formed with two annular grooves 231. The gasket 21 is fitted on the control valve shaft 23 and located between the two annular grooves 231. Two C-shaped retaining rings 232 are respectively fitted in the two annular grooves 231 to fix the gasket 21 on the control valve shaft 23.

The water outlet assembly C includes a water diversion body 4, a functional water switching device 5, and a water outlet panel 6, so that the present invention can achieve switching of different spray patterns.

Specifically, the water diversion body 4 is inserted into the shower head body A. The water diversion body 4 has a water inlet passage 41, a first water diversion passage 42, a second water diversion passage 43, and a functional water switching chamber 44. The water inlet body 1 and the water diversion body 4 are connected in a plug-in or snap-in manner. A water inlet end of the water inlet passage 41 of the water diversion body 4 communicates with the first water outlet 122 of the first flow channel 12 and the second water outlet 132 of the second flow channel 13. A side of the functional water switching chamber 44 is formed with a water inlet 441 communicating with the water outlet end of the water inlet passage 41. Upper and lower portions of the functional water switching chamber 44 are respectively formed with a first water diversion opening 442 and a second water diversion opening 443 opposite to each other. The first water diversion opening 442 and the second water diversion opening 443 are in communication with the first diversion passage 42 and the second water diversion passage 43, respectively.

The functional water switching device 5 includes a switching valve shaft 51, a sealing ring 52, and a switching button 53. The switching valve shaft 51 can slide up and down to pass through the functional water switching chamber 44. A lower portion of the switching valve shaft 51 is connected with the sealing ring 52 that is located in the functional water switching chamber 44 and is movable to close the first water diversion opening 442 and the second water diversion opening 443. The lower portion of the switching valve shaft 51 may be formed with an annular recess 511. The sealing ring 52 is inserted in the annular recess 511. A middle portion of the switching button 53 is hinged to the water diversion body 4. One end of the switching button 53 is connected to an upper portion of the switching valve shaft 51. In order to install the functional water switching device 5, the water outlet assembly C further includes a second sealing seat 7. The first water diversion opening 442 extends upwardly to pass through the side wall of the water diversion body 4. The second sealing seat 7 is fitted on the first water diversion opening 442. The second sealing seat 7 is formed with a through hole 71 through which the switching valve shaft 51 passes and a flow passage 72 communicating with the first water diversion opening 442 and the second water diversion opening 42. The shower head body A is provided with a second mating hole A2 for movement of the switching button 53. Wherein, the outer wall of the second sealing seat 7 is formed with at least two second ledges 73. The outer wall of the water diversion body 4 is formed with a second engaging block 45 to engage with the second ledges 73 so as to fix the second sealing seat 7.

The water outlet panel 6 is fitted on the shower head body A and is formed with two functional water chambers respectively communicating with the first water diversion passage 42 and the second water diversion passage 43. Specifically, the shower head body A may be formed with an inner threaded hole. The water outlet panel 6 is formed with an external screw thread matched with the inner threaded hole, so that the water outlet panel 6 is fitted on the shower head body A. The connection between the water outlet panel 6 and the shower head body A is not limited to the inner threaded hole and the external screw thread. The water outlet panel 6 and the shower head body A may be connected in a snap-fit manner. The two functional water chambers of the water outlet panel 6 may be a bubble water functional water chamber 61 and a shower water functional water chamber 62, respectively. Wherein, the bubble water functional water chamber 61 communicates with the first water diversion passage 42, and the shower water functional water chamber 62 communicates with the second water diversion passage 43.

It should be noted that the feature of the present invention is the water inlet body 1 and the flow control device 2. The water outlet assembly C is not limited to include the water diversion body 4, the functional water switching device 5 and the water outlet panel 6. The water outlet assembly C may adopt other water outlet structures as long as the water can be discharged. Therefore, the water outlet assembly C may include only one water outlet panel, so that the present invention provides only a single spray pattern.

In order to facilitate the understanding of the present invention, the following describes in detail the working process of controlling the flow rate in accordance with the present invention.

In the present invention, when the water inlet channel 11 of the water inlet body 1 is not yet fed with water, the gasket 21, the control valve shaft 23 and the control button 24 are in the initial position under the action of the return spring 22. At this time, the gasket 21 opens the second water outlet opening 143 and closes the first water outlet opening 142, and the second flow channel 13 is in communication with the water inlet channel 11.

With reference to FIG. 1, when the water flows into the water inlet channel 11 of the water inlet body 1, the gasket 21, the control valve shaft 23 and the control button 24 are still in the initial position under the action of the return spring 22, and the second flow channel 13 is in communication with the water inlet channel 11. The water flows from the water inlet channel 11 into the second flow channel 13 and then flows into the water outlet assembly C. Thereafter, if the water inlet channel 11 is closed, the gasket 21, the control valve shaft 23 and the control button 24 are still in the initial position under the elastic force of the return spring 22.

With reference to FIG. 2, in the case of water entering the water inlet channel 11, the control button 24 is pressed by the user to move the control valve shaft 23 downward, and the control valve shaft 23 drives the gasket 21 to move down to close the second water outlet opening 143 and to open the first water outlet opening 142. At this time, under the pressure of the water flow, the gasket 21 overcomes the elastic force of the return spring 22 and maintains the state of closing the second water outlet opening 143 and opening the first water outlet opening 142 for the first flow channel 12 to communicate with the water inlet channel 11, and the water flows from the water inlet channel 11 into the first flow channel 22 and then flows into the water outlet assembly C. After that, if the water inlet channel 11 is closed, the gasket 21 is no longer subjected to the pressure of the water flow. The gasket 21, the control valve shaft 23 and the control button 24 are returned to the initial position under the elastic force of the return spring 22. The gasket 21 opens the second water outlet opening 143 and closes the first water outlet opening 142, and the second flow channel 13 is in communication with the water inlet channel 11.

In order to facilitate the understanding of the present invention, the following describes in detail the working process of switching functional water in accordance with the present invention.

With reference to FIGS. 1 and 2, when the switching valve shaft 51, the sealing ring 52 and the switching button 24 of the present invention are in the initial position, the sealing ring 52 opens the second water diversion opening 443 and closes the first water diversion opening 442, and the second water diversion passage 43 is in communication with the water inlet passage 41. At this time, the water flows from the water inlet passage 41 into the second water diversion passage 43 and then flows into the shower water functional water chamber 62. If the user wants to switch the functional water, the end of the switching button 53 connected with the switching valve shaft 51 is pressed to move the switching valve shaft 51 downward. The switching valve shaft 51 drives the sealing ring 52 to move downward to close the second water diversion opening 443 and open the first water diversion opening 442. At this time, the first water diversion passage 42 is in communication with the water inlet passage 41. The water flows from the water inlet passage 41 into the first water diversion passage 42 and then flows into the bubble water functional water chamber 61 to discharge water, so that functional water is switched. Thereafter, if the other end of the switching button 53 is pressed to move the switching valve shaft 51 upward, the switching valve shaft 51 drives the sealing ring 52 to move upward to close the first water diversion opening 442 and open the second water diversion opening 443. At this time, the second water diversion passage 43 is in communication with the water inlet passage 41, and the water flows from the water inlet passage 41 into the second water diversion passage 43 and flows into the shower water functional water chamber 62 to discharge water, so that the functional water is switched.

Second Embodiment

Figure 3:
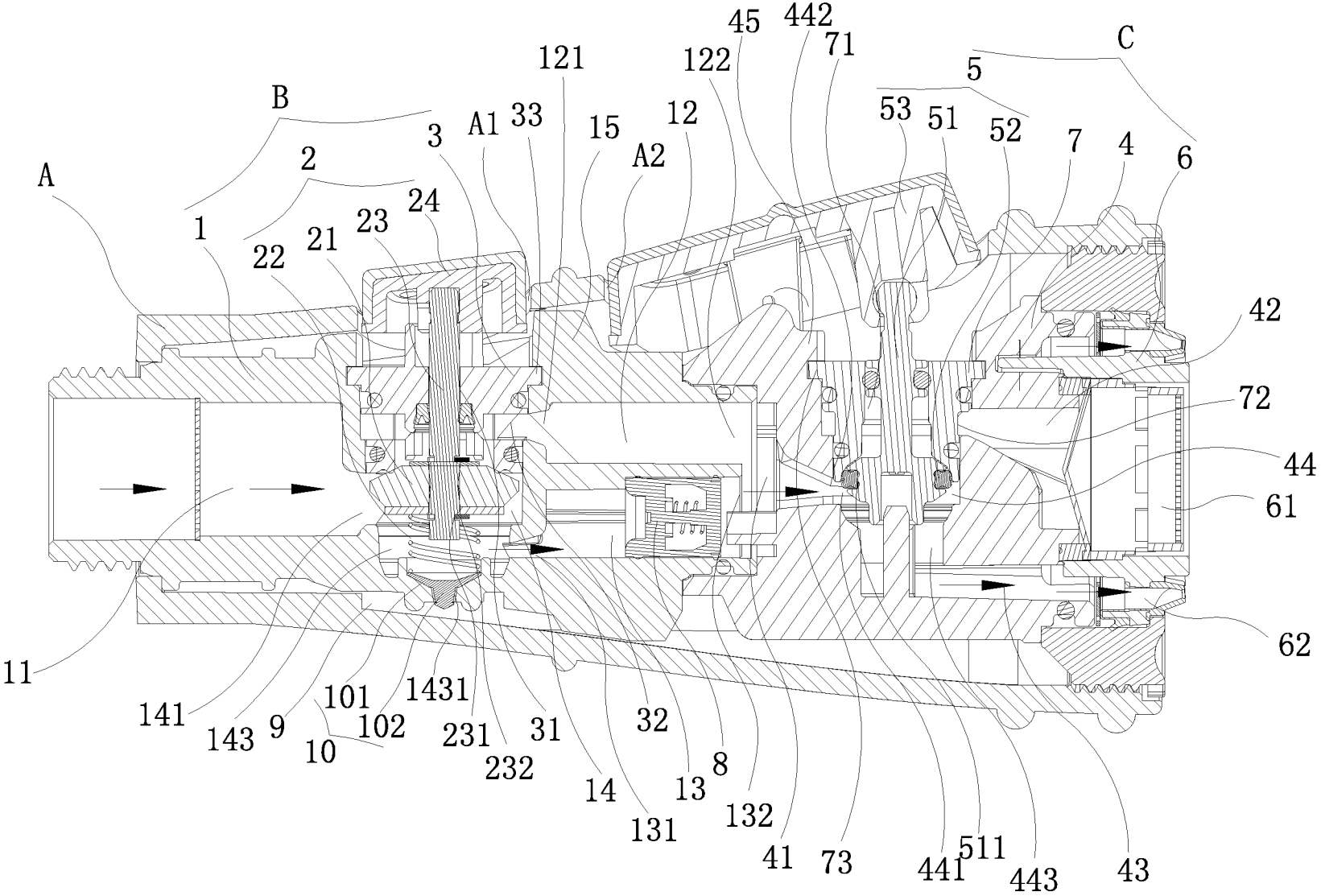
FIG. 3 is a first cross-sectional view in accordance with a second embodiment of the present invention (the water flows out from the second flow channel)
Figure 4:
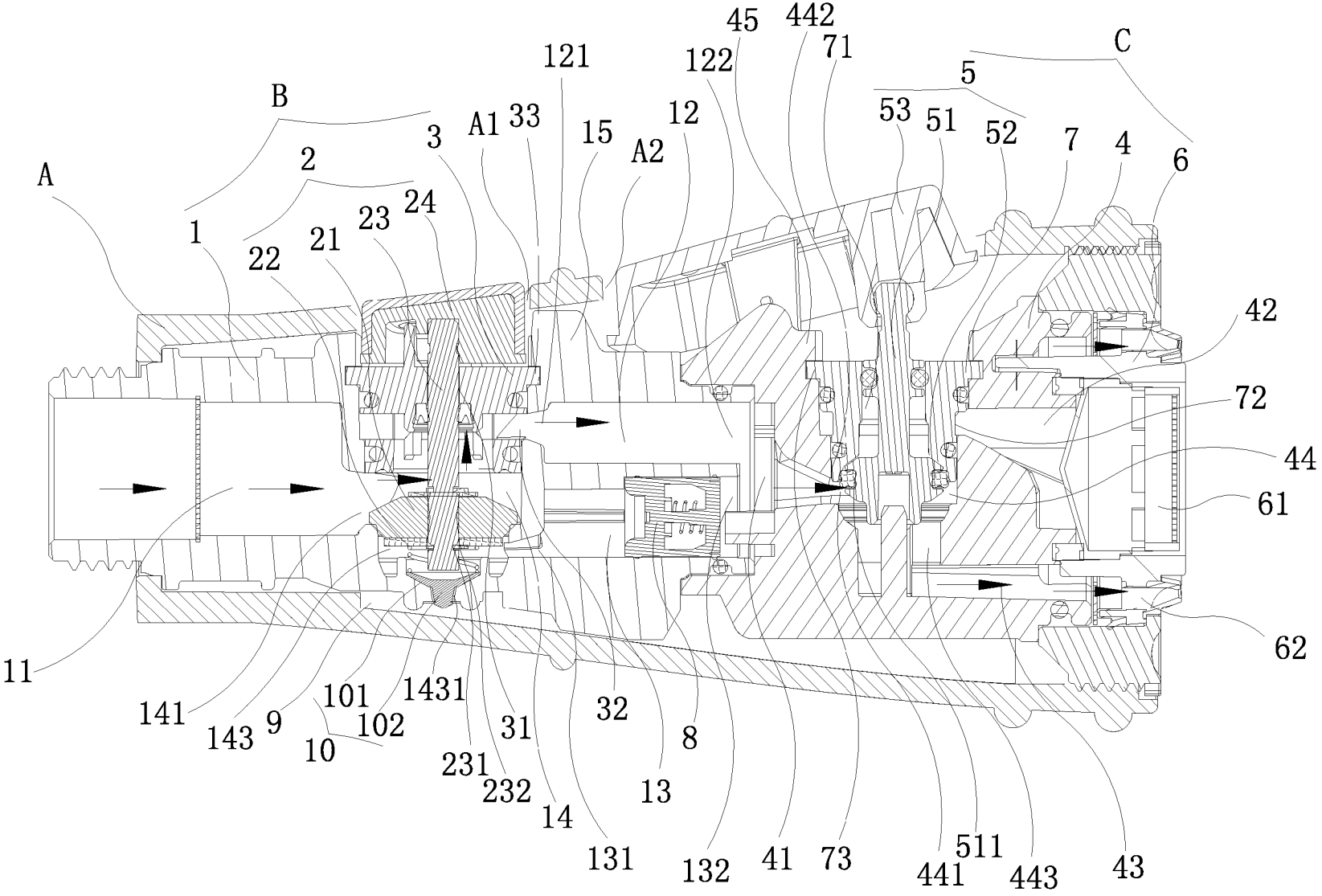
FIG. 4 is a second cross-sectional view in accordance with the second embodiment of the present invention (the water flows out from the first flow channel).

With reference to FIG. 3 and FIG. 4, this embodiment is a further improvement to the first embodiment. The improvement is that a check valve 8 is provided in the second flow channel 13. The check valve 8 can prevent the water from the first flow channel 12 from flowing into the second flow channel 13 to reduce the pressure difference between the upper and lower end faces of the gasket 21 and to affect the sealing effect that the gasket 21 closes the second water outlet opening 143.

Further, this embodiment can avoid this situation that the insufficient water pressure of the water flowing from the water inlet channel 11 results in that the gasket 21 cannot completely close the second water outlet opening 143 and that a part of the water flows from the second water outlet opening 143 into the second flow channel 13. However, the water flowing into the second flow channel 13 cannot open the check valve 8, so that the pressure in the second flow channel 13 increases to push the gasket 21 upward, which affects the use effect of the flow control device 2. In this embodiment, a pressure relief channel 9 is formed between the shower head body A and the water inlet body 11. The bottom of the second water outlet opening 143 is provided with a pressure relief hole 1431 communicating with the pressure relief channel 9. The bottom of the second water outlet opening 143 is provided with a pad 10 that is movable to close the pressure relief hole 1431. Specifically, the pad 10 includes an elastic extension plate 101 and a connecting post 102 connected to a middle portion of the elastic extension plate 101. The thickness of the elastic extension plate 101 is gradually reduced from the middle portion of the elastic extension plate 101 toward the periphery of the elastic extension plate 101. The elastic extension plate 101 is movably attached to the bottom of the second water outlet opening 143. The connecting post 102 is in clearance fit with the pressure relief hole 1431. When the control valve shaft 23 and the control button 24 are in the initial position under the action of the return spring 22, the elastic extension plate 101 of the pad 10 is greatly affected by the pressure of the water flow and extended to close the pressure relief hole 1431 so as to prevent the water from flowing away from the pressure relief hole 1431 to ensure that the water flows into the second flow channel 13. When the control button 24 is pressed, the control valve shaft 23 is moved downward, and the control valve shaft 23 drives the gasket 21 to move downward to close the second outlet water opening 143 and open the first water outlet opening 142. At this time, the elastic extension plate 101 of the pad 10 is less affected by the pressure of the water flow and doesn't close the pressure relief hole 1431. The pressure relief hole 1431 is opened so that the pressure in the second flow channel 13 is decreased, thereby increasing the pressure difference between the upper and lower end faces of the gasket 21. The sealing effect of the gasket 21 on the second water outlet opening 143 is better.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A handheld shower head, comprising a shower head body, a water inlet assembly and a water outlet assembly mounted on the shower head body; the water inlet assembly including a water inlet body and a flow control device;

the water inlet body being fitted in the shower head body, the water inlet body having a water inlet channel, a first flow channel, a second flow channel and a flow control chamber; a side of the flow control chamber being formed with a water inlet hole communicating with the water inlet channel, upper and lower portions of the flow control chamber being respectively formed with a first water outlet opening and a second water outlet opening opposite to each other, a first water inlet of the first flow channel communicating with the first water outlet opening, a second water inlet of the second flow channel communicating with the second water outlet opening; a first water outlet of the first flow channel and a second water outlet of the second flow channel communicating with a water inlet end of the water outlet assembly;

the flow control device including a gasket, a return spring, a control valve shaft and a control button; the control valve shaft being movable up and down to pass through the flow control chamber, a lower portion of the control valve shaft being connected with the gasket, the gasket being located in the flow control chamber and being movable to close the first water outlet opening and the second water outlet opening, the return spring being disposed between the gasket and the second water outlet opening, upper and lower ends of the return spring abutting against the gasket and the water inlet body respectively; the control button being connected with an upper portion of the control valve shaft and being movably fitted on the shower head body;

wherein the water outlet assembly is operatively separate from the water inlet assembly and includes a water diversion body, a functional water switching device and a water outlet panel;

the water diversion body is inserted into the shower head body, the water diversion body has a water inlet passage, a first water diversion passage, a second water diversion passage and a functional water switching chamber; the water inlet body is connected with the water diversion body, a water inlet end of the water inlet passage communicates with the first water outlet of the first flow channel and the second water outlet of the second flow channel, a side of the functional water switching chamber is formed with a water inlet communicating with a water outlet end of the water inlet passage, upper and lower portions of the functional water switching chamber are respectively formed with a first water diversion opening and a second water diversion opening opposite to each other, the first water diversion opening and the second water diversion opening being in communication with the first water diversion passage and the second water diversion passage, respectively;

the functional water switching device includes a switching valve shaft, a sealing ring and a switching button; the switching valve shaft is movable up and down to pass through the functional water switching chamber, a lower portion of the switching valve shaft is connected with the sealing ring that is located in the functional water switching chamber and is movable to close the first water diversion opening and the second water diversion opening; a middle portion of the switching button is hinged to the water diversion body, one end of the switching button is connected to an upper portion of the switching valve shaft;

the water outlet panel is fitted on the shower head body and is formed with two functional water chambers communicating with the first water diversion passage and the second water diversion passage, respectively.

2. The handheld shower head as claimed in claim 1, wherein the first water inlet of the first flow channel has a diameter greater than that of the second water inlet of the second flow channel.

3. The handheld shower head as claimed in claim 1, wherein a check valve is provided in the second flow channel.

4. The handheld shower head as claimed in claim 3, wherein a pressure relief channel is formed between the shower head body and the water inlet body, a bottom of the second water outlet opening is provided with a pressure relief hole communicating with the pressure relief channel, and the bottom of the second water outlet opening is provided with a pad that is movable to close the pressure relief hole.

5. The handheld shower head as claimed in claim 4, wherein the pad includes an elastic extension plate and a connecting post connected to a middle portion of the elastic extension plate, the elastic extension plate has a thickness that is gradually reduced from the middle portion of the elastic extension plate toward a periphery of the elastic extension plate; the elastic extension plate is movably attached to the bottom of the second water outlet opening, and the connecting post is in clearance fit with the pressure relief hole.

6. The handheld shower head as claimed in claim 1, wherein the water inlet assembly further includes a first sealing seat, the first water outlet opening extends upwardly to pass through a side wall of the water inlet body, the first sealing seat is fitted on the first water outlet opening; the first sealing seat is formed with a perforation through which the control valve shaft passes and a water passageway communicating with the first water outlet opening and the first flow channel, and the shower head body is provided with a first mating hole for movement of the control button.

7. The handheld shower head as claimed in claim 6, wherein an outer wall of the first sealing seat is formed with at least two first ledges; and an outer wall of the water inlet body is formed with a first engaging block to engage with the first ledges.

8. The handheld shower head as claimed in claim 1, wherein a side wall of the control valve shaft is formed with two annular grooves; the gasket is fitted on the control valve shaft and located between the two annular grooves, and two C-shaped retaining rings are fitted in the two annular grooves, respectively.

9. The handheld shower head as claimed in claim 1, wherein the water outlet assembly further includes a second sealing seat, the first water diversion opening extends upwardly to pass through a side wall of the water diversion body, the second sealing seat is fitted on the first water diversion opening; the second sealing seat is formed with a through hole through which the switching valve shaft passes and a flow passage communicating with the first water diversion opening and the second water diversion opening; and the shower head body is provided with a second mating hole for movement of the switching button.

10. The handheld shower head as claimed in claim 9, wherein an outer wall of the second sealing seat is formed with at least two second ledges; and an outer wall of the water diversion body is formed with a second engaging block to engage with the second ledges.

11. The handheld shower head as claimed in claim 1, wherein the lower portion of the switching valve shaft is formed with an annular recess, and the sealing ring is fitted in the annular recess.

* * * * *